US007702250B2

(12) United States Patent
Yoda

(10) Patent No.: US 7,702,250 B2
(45) Date of Patent: Apr. 20, 2010

(54) HEATING SYSTEM AND IMAGE FORMING APPARATUS ADOPTING THE SAME

(75) Inventor: Junya Yoda, Osaka (JP)

(73) Assignee: Kyocera Mita Corporation (JP)

( * ) Notice: Subject to any disclaimer, the term of this patent is extended or adjusted under 35 U.S.C. 154(b) by 49 days.

(21) Appl. No.: 11/888,040

(22) Filed: Jul. 31, 2007

(65) Prior Publication Data

US 2008/0031652 A1 Feb. 7, 2008

(30) Foreign Application Priority Data

Aug. 2, 2006 (JP) ..... 2006-211058

(51) Int. Cl.
*G03G 15/00* (2006.01)

(52) U.S. Cl. ..... 399/88; 399/322; 399/325; 399/328

(58) Field of Classification Search ..... 399/88, 399/322, 325, 328
See application file for complete search history.

(56) References Cited

U.S. PATENT DOCUMENTS 4,113,375 A * 9/1978 Murata et al. ..... 399/88
6,370,046 B1 * 4/2002 Nebrigic et al. ..... 363/60
2006/0222395 A1 * 10/2006 Yoda ..... 399/69
2008/0253787 A1 * 10/2008 Yoda ..... 399/69

FOREIGN PATENT DOCUMENTS

| | | |
|---|---|---|
| JP | 2000-315567 | 11/2000 |
| JP | 2003-297526 | 10/2003 |
| JP | 2004-266984 | 9/2004 |
| JP | 2005-032558 | 2/2005 |
| JP | 2005-221685 | 8/2005 |

* cited by examiner

*Primary Examiner*—David M Gray
*Assistant Examiner*—Geoffrey T Evans
(74) *Attorney, Agent, or Firm*—Gerald E. Hespos; Michael J. Porco

(57) ABSTRACT

A heating system including: a heating device including a first heat generator supplied with electric power by a commercial power source device, and a second heat generator and a third heat generator supplied with electric power by an auxiliary power source device; an electric storage device composed of a capacitor; a discharger for pursuing discharge to raise an input voltage from the electric storage device and supplying an electric power to the second and third heat generators; a detector for detecting an input voltage from the electric storage device to the discharger; and a power supply controller for switching off the electric power supply from the discharger to the third heat generator when the detector detects a reaching of the input voltage to a first threshold value which is set as a value in connection with a permissible limit of an input electric current to the discharger.

4 Claims, 7 Drawing Sheets

HEATING SYSTEM AND IMAGE FORMING APPARATUS ADOPTING THE SAME

BACKGROUND OF THE INVENTION

1. Field of the Invention

The present invention relates to a heating system provided with an auxiliary power source which supports an electric power supply to a heating device such as a fixing device, and an image forming apparatus adopting the same.

2. Description of the Related Art

Conventionally, in image forming apparatuses such as a copying machine, a complex machine, a printer and a facsimile machine, there has been a known method of using an auxiliary power source composed of a high-capacity capacitor such as an electric double layer capacitor to support a power supply to a fixing device, as a method for reducing a standby electricity as much as possible and shortening a fixing start-up time i.e. a method for allowing the fixing temperature to rise promptly (for example, refer to Japanese Examined Patent No. 3588006). Since the electric double layer capacitor is capable of charging and discharging electricity at a high current and has a long capacitor life (more than hundred thousand times of charging), it is adapted to be used as an auxiliary power source for a heat generator such as a halogen heater for use in the fixing start-up. However, since a charging voltage of the electric double layer capacitor as a single body is generally about 2.5V, which is low, a method has been devised in which a voltage-raising circuit is provided between the capacitor and the heat generator, and the voltage-raising circuit is used to raise the output voltage (capacitor voltage, discharging voltage) from the capacitor to a necessary voltage for the heat generator (for example, refer to Japanese Patent Unexamined Publication Nos. 2003-297526 and 2004-266984).

In a case where a predetermined voltage is applied to the heat generator with use of the voltage raised by the voltage-raising circuit as described above and outputted from the capacitor, the voltage after the discharging lowers and the input current to the voltage-raising circuit increases when deterioration of the capacitor advances. Accordingly, it is necessary to provide a protective circuit for stopping an output so as not to cause a failure in an input portion of the voltage-raising circuit. However, such method of merely stopping an output in accordance with deterioration of the capacitor causes a problem that the supporting of the electric power supply is disabled as soon as the capacitor reaches the end of a rated life duration (even though use of a capacitor is still possible) even in a case where supporting of an electric power supply by the capacitor should be continued although the fixing start-up time becomes longer than the rated life duration.

SUMMARY OF THE INVENTION

An object of the present invention is to provide a heating system capable of continuing the supporting of an electric power supply within a safe operation range of the discharger (voltage-raising circuit) even after the capacitor reaches the end of the rated life duration without disabling the supporting of the electric power supply as soon as the capacitor reaches the end of the rated life duration. Further, another object of the present invention is to provide an image forming apparatus including the heating system.

According to one aspect of the present invention, the heating system includes: a heating device including a first heat generator supplied with electric power by a commercial power source, and a second heat generator and a third heat generator supplied with electric power by an auxiliary power source device; an electric storage device composed of a capacitor; a discharger for pursuing discharge to raise an input voltage from the electric storage device and supplying an electric power to the second and third heat generators; a detector for detecting an input voltage from the electric storage device to the discharger; and a power supply controller for switching off the electric power supply from the discharger to the third heat generator when the detector detects a reaching of the input voltage to a first threshold value which is set as a value in connection with a permissible limit of an input electric current to the discharger.

These and other objects, features and advantages of the present invention will become more apparent upon reading of the following detailed description along with the accompanied drawings.

DETAILED DESCRIPTION OF THE PREFERRED EMBODIMENTS

Figure 1:
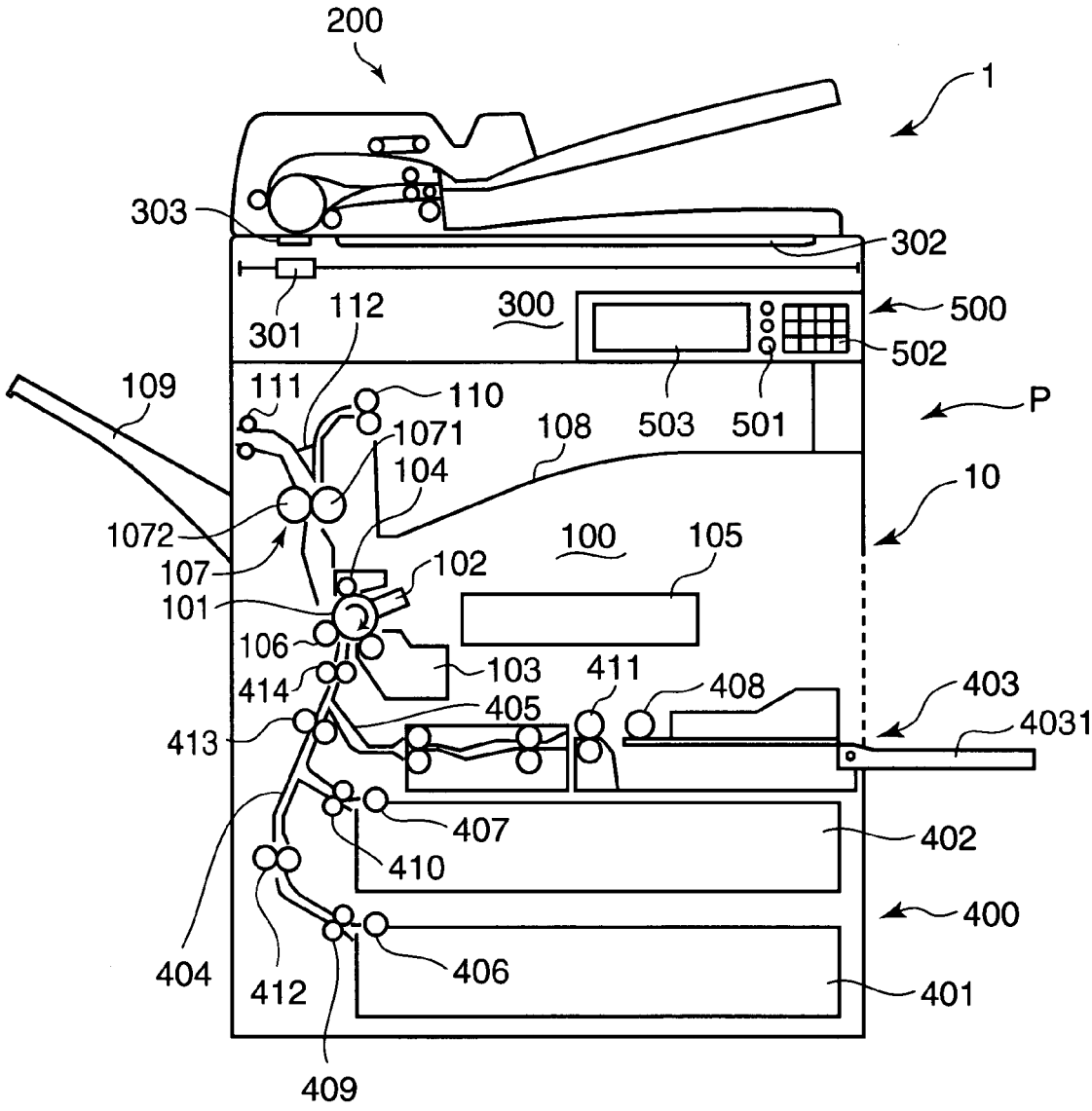
FIG. 1 is a sectional view schematically showing a configuration of a copying machine which is an example of an image forming apparatus adopting a heating system according to one embodiment of the present invention.

Hereinafter, a heating system and an image forming apparatus according to an embodiment of the present invention will be described with reference to the drawings. FIG. 1 is a sectional view schematically showing a configuration of a copying machine which is an example of the image forming apparatus adopting the heating system according to the embodiment of the present invention. A copying machine 1 includes an image forming section 100, a document feeding section 200 provided on a main body section 10 including the image forming section 100, a document reading section 300 provided in an upper part of the main body section 10, a sheet feeding section 400 provided in a lower part of the main body section 10, and an operation display section 500 provided in a front portion of the main body section 10.

The document reading section 300 reads out a document and creates image data corresponding to the document. The document reading section 300 includes a scanner 301 having a CCD (Charge Coupled Device) sensor and an exposure lamp for creating image data in accordance with an optically-acquired image of the document. In an upper surface of the document reading section 300, there are provided a first platen glass 302 for use in reading a manually-fed document, and a second platen glass 303 for use in reading a document fed through an ADF. The document reading section 300 scans a document which is placed on the first platen glass 302 or conveyed (moved) in contact with the second platen glass 303 by the document feeding section 200 and acquires image data of the document, and then outputs the acquired image data to a control device 60.

The document feeding section 200 (ADF; Auto Document Feeder) feeds a document to the document reading section 300 (a document reading position of the second platen glass 303), and discharges the document read out by the image reading section 300 to a discharging portion of the document feeding section 200. The document feeding section 200 is pivotally supported at a rear surface side of the image forming apparatus and is openable and closable with respect to an upper surface of the main body section 10 (document reading section 300). When the sheet feeding section 200 is lifted upward and rearward so as to make the first platen glass 302 (second platen glass 303) be open, a document to be read, such as a book which is opened, can be placed on the first platen glass 302.

The sheet feeding section 400 feeds a sheet to the image forming section 100. The sheet feeding section 400 includes a plurality of sheet feeding cassettes e.g. sheet feeding cassettes 401, 402 for storing sheets (recording sheets) of respective sizes, and a manual sheet feeding portion 403 composed of a manual feeding tray 4031 which is freely opened and closed at one side of the main body section 10.

Further, the sheet feeding section 400 includes a conveyance passage 404 for conveying a sheet from the sheet feeding cassettes 401, 402 to the image forming section 100, and a conveyance passage 405 for conveying a sheet from the manual feeding portion 403 to the image forming section 100. The sheet feeding cassettes 401, 402 and the manual feeding portion 403 respectively include pickup rollers 406, 407, 408 for taking out a stored recording sheet, and sheet feeding rollers 409, 410, 411 for sending out the sheet one after another to respective conveyance passages. The conveying passage 404 is provided with conveying rollers 412, 413 for conveying sheets and a registration roller 414 for allowing the conveyed sheet to wait before the image forming section 100. The conveyance passage 405 merges with the conveyance passage 404 on the upstream side of the registration roller 414.

The image forming section 100 forms (prints) a predetermined image on a recording sheet conveyed by the sheet feeding section 400. The image forming section 100 includes a photoconductive drum 101 supported rotatably in a direction of the arrow shown in FIG. 1; a charging portion 102, a developing portion 103, a cleaning portion 104, a laser-scanning unit 105, and a transferring portion 106 each provided along a peripheral surface of the photoconductive drum 101; and a fixing portion 107 provided on downstream side of the transferring portion 106.

The charging portion 102 uniformly charges the surface of the photoconductive drum 101 at a predetermined electric potential. The laser-scanning unit 105 irradiates a laser beam to the surface of the photoconductive drum 101 based on the image data transmitted from an image storage portion (unillustrated) provided in the copying machine 1 and forms an electrostatic latent image on the surface of the photoconductive drum 101. The developing portion 103 allows toner particles to attach to the electrostatic latent image to develop an image (document image). The transferring portion 106 has a transferring roller and presses the conveyed sheet onto the photoconductive drum 101 with the transferring roller to allow the toner image developed on the photoconductive drum 101 to transfer onto the sheet.

The fixing portion 107 fixes at a predetermined fixing temperature the toner image transferred onto the sheet. The fixing portion 107 includes a heating roller 1071, and a pressing roller 1072 which applies a pressing force to the heating roller 1071. The heating roller 1071 melts toner particles on a recording sheet by heat, and the pressing roller 1072 applies a pressing force, thereby fixing the toner onto the sheet. The cleaning portion 104 cleans toner particles remaining on the surface of the photoconductive drum 101 after the image transfer to the sheet is terminated.

At an upper portion and a side portion of the main body portion 10, there are provided sheet discharging trays 108, 109. The sheets conveyed from the fixing portion 107 are discharged to the discharging trays 108, 109 by the discharging rollers 110, 111 respectively. A branching guide 112 is operable to switch conveyance directions between the side of the discharging roller 110 and the side of the discharging roller 111.

The operation display portion 500 allows a user to make an operation to input a predetermined instruction. The operation display portion 500 includes a start key 501 for allowing a user to input a printing instruction, numerical keys 502 for allowing a user to input the number of copies, a display device 503 and the like. The display device 503 is composed of a liquid crystal display (LCD; Liquid Crystal Display) which displays operation guide information and the like for allowing a user to input settings of various copying operations and the like and displays various operation buttons and the like.

Figure 2:
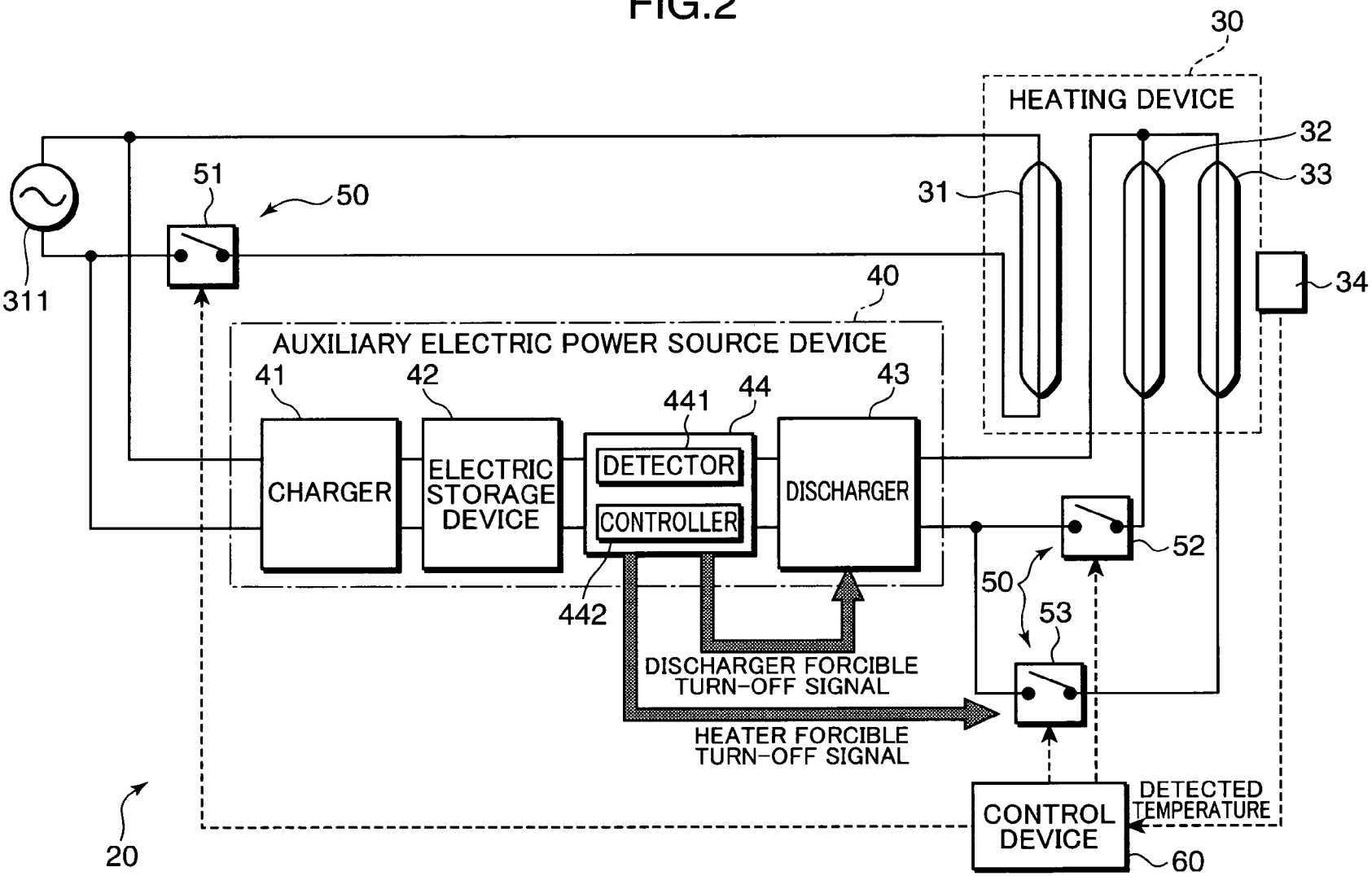
FIG. 2 is a block diagram showing a configuration of an example of the heating system shown in FIG. 1.

FIG. 2 is a block diagram showing a configuration of an example of a heating system 20 provided in a copying machine having the above-described configuration. The heating system 20 includes a heating device 30, an auxiliary power source device 40, a group of switches 50, and a control device 60. The heating device 30 corresponds to the fixing portion 107. Specifically, the heating device 30 is a group of heaters such as halogen heaters which are heat generators provided in the heat roller 1071 for generating heat so that the fixing portion 107 acquires a desired fixing temperature. The heating device 30 includes a first heater 31, a second heater 32, and a third heater 33 as a group of heaters.

The first heater 31 is so called main heater which is driven (generates heat) with an electric power supply from an external power source (AC power source) such as a commercial power source 311. The second heater 32 and the third heater 33 are so called sub-heaters (auxiliary heaters) provided together with the first heater 31 for pursuing an auxiliary heating for the first heater 31 so as to shorten the time (fixing start-up time) for raising the temperature of the fixing portion 107 to a desired fixing temperature. The second and third heaters 32, 33 are driven with the electric power supply from the auxiliary power source device 40. The copying machine 1 may be provided with a main power source device (unillustrated) for supplying the electric power from the commercial power source 311 to portions of the copying machine 1. Further, the heating device 30 includes a thermistor 34 for detecting a temperature (fixing temperature) of the fixing portion 107 i.e. a temperature in vicinity of the respective heaters 31-33. The temperature information detected by the thermistor 34 is transmitted to the control device 60.

The auxiliary power source device 40 includes a power source device for supporting the electric power supply to the second heater 32 and the third heater 33 of the heating device 30. The auxiliary power source device 40 includes a charger 41, a electric storage device 42, a discharger 43, and a protecting unit 44. The charger 41 is in a wire connection with the commercial power source 311 and charges the electric storage device 42 with electric power supplied from the commercial power source 311. The electric storage device 42 includes an electric double layer capacitor for storing electric power supplied from the charger 41. An electric double layer capacitor is an electricity storage device (high-capacity capacitor) which uses a principle called an electric double layer to realize an electric capacity of more than some thousands times greater than a conventional capacitor.

The discharger 43 discharges and outputs electricity stored in the electric storage device 42. The discharger 43 is in a wire connection with the second and third heaters 32, 33, and the electric power outputted from the discharger 43 is supplied to the second and third heaters 32, 33. The protecting unit 44 detects an input voltage from the electric storage device 42 to the discharger 43 and controls the electric power supply. Functions and operations of the protecting unit 44 will be described hereinafter.

The group of switches 50 is provided at portions of the heating system 20 for performing switching of ON and OFF. Here, the group of switches 50 includes a first switch 51, a second switch 52, and a third switch 53. The first switch 51 is provided on a wire line connecting the commercial power source 311 and the first heater 31, and performs switching of ON and OFF of the electric power supply from the commercial power source 311 to the first heater 31. When the first switch 51 is switched on, the electric power is supplied from the commercial power source 311 to the first heater 31, and the first heater 31 generates heat.

The second switch 52 and the third switch 53 are respectively provided on wire lines connecting the discharger 43 with the second heater 32 and the third heater 33, and perform switching of ON and OFF of the electric power supply from the discharger 43 (auxiliary power source device 40) to the second heater 32 or the third heater 33. When the second switch 52 is turned on, the discharger 43 supplies the electric power to the second heater 32, and then the second heater 32 generates heat. When the third heater 33 is turned on, the discharger 43 supplies the electric power to the third heater 33, and then the third heater 33 generates heat. Any switch such as a mechanical switch and an electric switch may be adopted as long as the switch is capable of switching ON and OFF.

The control device 60 is composed of a ROM for storing a control program of the copying machine 1, a RAM for temporarily storing data, and a CPU for reading out the control program and the like from the ROM and executing the same, and controls a whole apparatus in accordance with a predetermined instruction information inputted through the operation display portion 500 and the like, and a detection signal transmitted from various sensors provided at respective portions of the apparatus. Especially, in the present embodiment, the CPU controls driving of the first through third switches 51-53 provided respectively for the first through third heaters 31-33 i.e. ON/OFF operation in accordance with temperature information detected by the thermister 34 to thereby control the temperature (fixing temperature) of the heating device 30.

Meanwhile, the discharger 43 has a voltage-raising circuit (or a discharging circuit having a function of raising the voltage, which is unillustrated). The voltage-raising circuit has raises the voltage for the second and third heaters 32, 33 to a necessary level even when the input voltage from the electric storage device 42 lowers at the time of discharging. In accordance with the principle of operation of the voltage-raising circuit, a small electric current would be enough to obtain a necessary electric power when the input voltage is high, taking in consideration of the relationship of power=current*voltage (W=A*V). However, when an input voltage is small, more electric current would be necessary.

Specifically, for example, in a case where the second and third heaters 32, 33 are halogen heaters each having a rating of 75V, 13 A and 900 W, and the electric storage device 42 is composed of an electric double layer capacitor having a full-charge voltage of 40V, it would be necessary to provide the voltage-raising circuit which raises the input voltage from 40V to 75V and outputs the same. The electric double layer capacitor has a characteristic of lowering the voltage when an electric power is supplied, and the following formula (1) works out.

$$U=(1/2)*C*V^2 \quad (1)$$

It is given that U=electrostatic energy [J], C=electric capacity [F], and V=charged voltage [V].

When it is given that an electrostatic capacity of the capacitor is 80 F, the energy stored at a full-charge voltage of 40V is $U=(1/2)*80*40^2=64000$ J. Further, when the second heater 32 and the third heater 33 are switched on together for ten seconds, the energy consumed in these heaters becomes U=900*2*10=18000 J. When it is given that a power conversion efficiency in the voltage-raising circuit of the discharger 43 is 80%, the energy taken out from the capacitor would be 18000/0.8=22500 J. Accordingly, the energy left in the capacitor would be 64000−22500=41500 J, so the charge voltage V of the capacitor after the discharging becomes $V=\sqrt{(2*U/C)}=\sqrt{(2*41500/80)}=32.2V$.

When the electrostatic capacity of the capacitor is deteriorated by −20% and becomes 64 F, the energy stored at full-charge voltage becomes $U=1/2*64*40^2=51200$ J. Thus, the energy left in the capacitor after each heater is switched on becomes 51200−22500=28700 J. Therefore, the charge voltage V of the capacitor after the discharging becomes $V=\sqrt{(2*U/C)}=\sqrt{(2*28700/64)}=29.9V$.

When an input voltage of the voltage-raising circuit before deterioration of the capacitor is 32.2V, an input current of the voltage-raising circuit would be 69.9 A (within a rating of 75 A). When an input voltage after the deterioration of the capacitor is 29.9V, an input current of the voltage-raising circuit would be 75.3 A (over the rating of 75 A).

As described above, when the deterioration of the capacitor occurs (in this case, it is in the "initial stage of deterioration" with respect to the "last stage of deterioration" described hereinafter), and the input voltage from the electric storage device 42 to the discharger 43 (voltage-raising circuit) drops (the voltage after the discharging drops), the input current increases. When the input current increases beyond a capacity of the voltage-raising circuit, a failure and the like occurs. Therefore, it would be necessary to provide at an input portion of the voltage-raising circuit a protector for pursuing protection such as stopping an operation (output) of the voltage-raising circuit so as not to make the failure and the like occur. In the present embodiment, a protecting unit 44 as a protector is arranged between the electric storage device 42 and the discharger 43, as shown in FIG. 2.

The protecting unit 44 includes a voltage detector 441 and a power supply controller 442. The voltage detector 441 is an item such as a voltage detecting circuit for detecting an input voltage from the electric storage device 42 to the discharger 43. The power supply controller 442 controls a power supply from the auxiliary power source device 40 to the second and third heaters 32, 33. Specifically, the power supply controller 442 controls the power supply by controlling an operation of the third switch 53 or the discharger device 43 based on voltage detection information given by the voltage detector 441. In other words, the power supply controller 442 switches off the third switch 53 for switching the power supply from the discharger 43 to the third heater 33 when the voltage detector 441 detects a reaching of the input voltage from the electric storage device 42 to the discharger 43 to a predetermined voltage (which is named the first threshold value) which is set in connection with a permissible limit of the input current to the discharger 43. Accordingly, the power supply to the third heater 33 is forcibly stopped such that the power supply from the auxiliary power source device 40 is given only to the second heater 32.

In an actual operation, the voltage detector 441 monitors the input voltage from the electric storage device 42 to the discharger 43 all the time. When the voltage detector 441 detects the drop in the input voltage to a predetermined voltage, it outputs a detection signal (detection result information) to the power supply controller 442. The power supply controller 442 receives the detection signal and outputs to the third switch 53 a control signal (heater forcible turn-off signal) of switching off the third switch 53. The third switch 53 receives the heater forcible turn-off signal and switches off itself. The third switch 53 prioritizes, in its operation, the heater forcible turn-off signal over the ON/OFF control signal transmitted from the control device 60 for controlling ON/OFF operation of the third switch 53.

Figure 3:
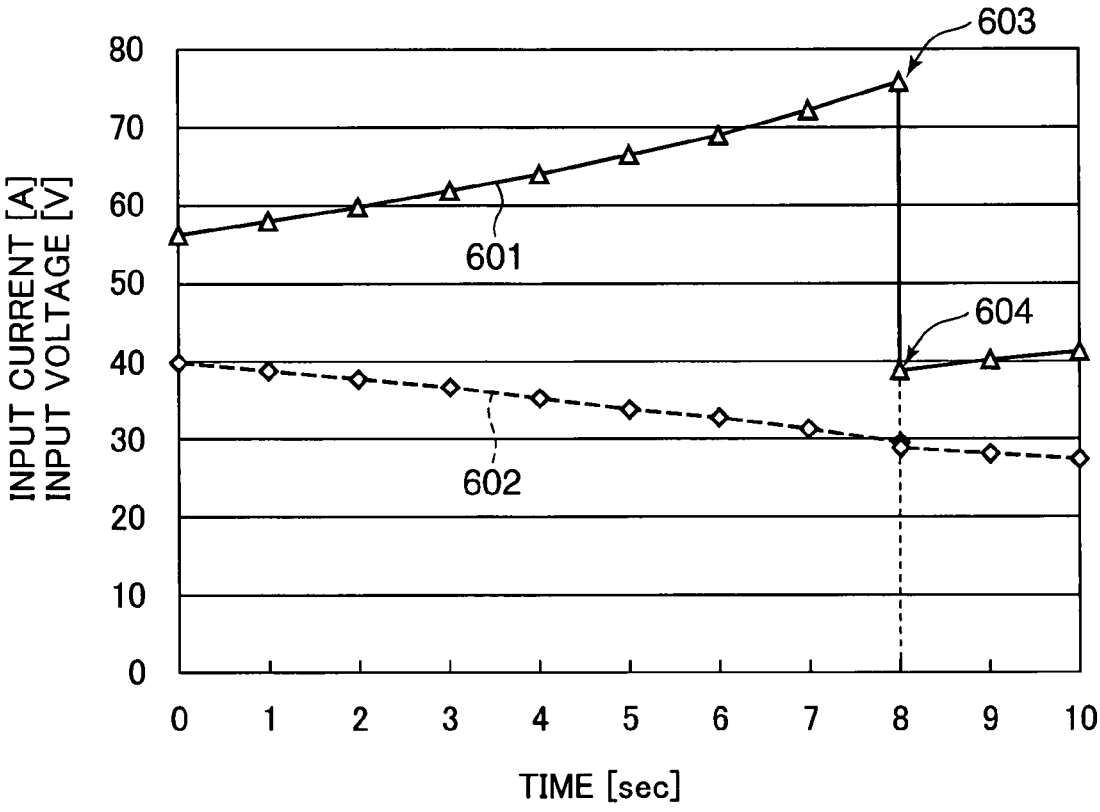
FIG. 3 is a graph showing chronological changes of the input voltage and the input current from a capacitor to a discharger in an initial stage of deterioration of the capacitor.
Figure 4:
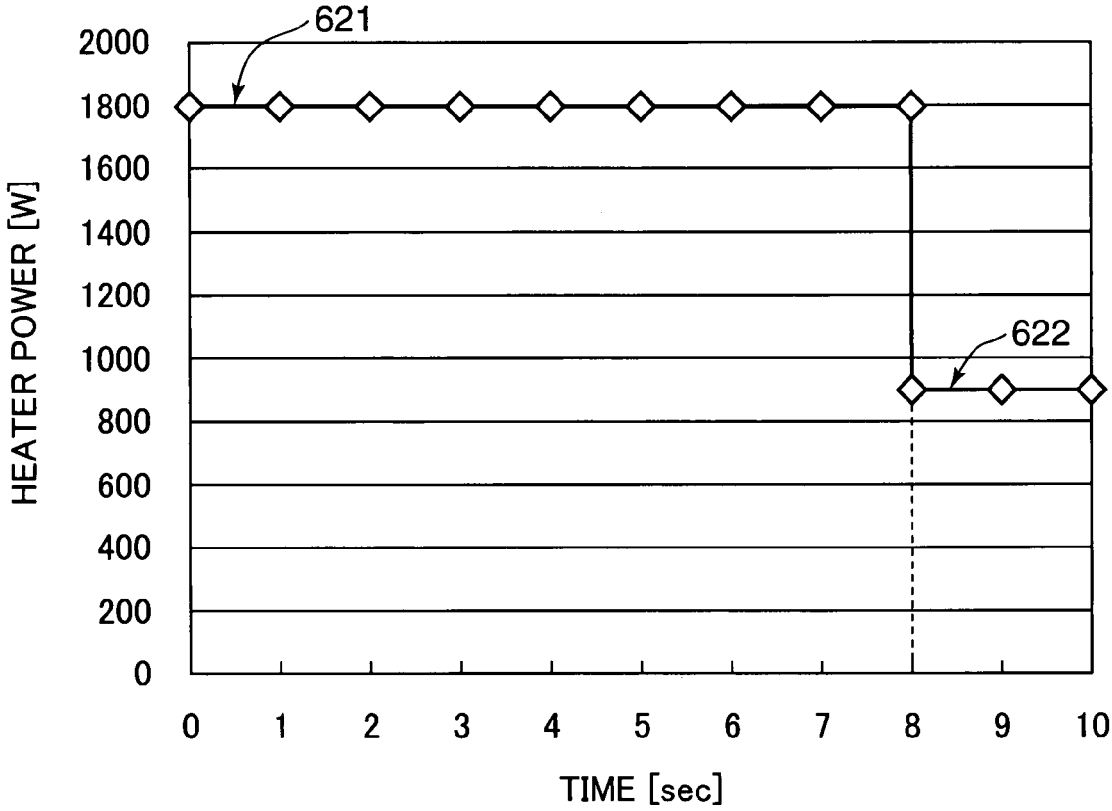
FIG. 4 is a graph corresponding to FIG. 3 and showing chronological changes of the total electric power of the second and third heat generators in the initial stage of deterioration of the capacitor.

This operation will be described with a specific example. FIG. 3 is a graph showing chronological changes of the input voltage and the input current from the electric storage device 42 to the discharger 43 in the initial stage of deterioration of the capacitor. The graph identified with a reference numeral 601 in FIG. 3 shows an input current change characteristic (input current change characteristic 601). The graph identified with a reference numeral 602 shows an input voltage change characteristic (input voltage change characteristic 602). FIG. 4 is a graph showing chronological changes of the total power value (Watt) of the second and third heaters 32, 33. The time axis of FIG. 4 corresponds to the time axis of FIG. 3.

As identified with a reference numeral 621 in FIG. 4, the second heater 32 and the third heater 33 each having a rating power 900 W are driven together to start auxiliary heating at a heater power of 1800 W in total. As shown in the input voltage change characteristic 602 of FIG. 3, the input voltage initially being 40V gradually drops as time passes by. On the other hand, in accordance with the drops of the input voltage, the input current rises. When it is given that the rated value of the input current of the voltage-raising circuit in the discharger 43 i.e. an upper limit (permissible limit) of the input current is 75 A, the input current reaches the rated value (75 A or the value close to 75 A) at eight seconds later as indicated by the point of the reference numeral 603. In other words, the capacitor comes to the end of the rated life duration. Therefore, when the protecting unit 44 detects an input voltage of 29.9V (hereinafter, referred to as a first lower limit voltage, the first lower limit voltage corresponds to the first threshold value) at eight seconds later, it switches off the third switch 53 to stop the power supply from the discharger 43 to the third heater 33. The first lower limit voltage value, which is "29.9V" here, is a value acquired in advance by a measurement result of an experiment and the like as an input voltage obtained at the time when the input current reaches the upper limit value (rated value). It should be noted that the first lower limit voltage is not limited to 29.9V, but may be any desirable value.

Accordingly, the second heater 32 becomes the only one heater which receives the power supply from the discharger 43, and the heater power having been 1800 W in the initial stage drops to 900 W as identified reference numeral 622. At the time when the heater power drops to 900 W, the input current drops to half the rated value as identified with the point of the reference numeral 604 in FIG. 3.

As described above, the protecting unit 44 monitors the input voltage. When the protecting unit 44 detects a reaching of the input voltage to the first lower limit voltage at which the input current reaches the rated value, it forcibly turns off the driving of one of the second and third heaters 32, 33 (here, it is the third heater 33) to lower the input current, thereby enabling an auxiliary heating to continue within a safe operation range of the voltage-raising circuit, in other words, without causing a failure in the voltage-raising circuit.

However, even though the system requires 18000 J to start up the fixing portion 107 in ten seconds (the rated time for starting up the fixing is set to be ten seconds, for example), only 1800 W*8+900 W*2=16200 J can be obtained in ten seconds (eight seconds+two seconds) in the case of the above-described example as shown in FIG. 4. Accordingly, the electric power runs short, and it takes more than ten seconds to start up the fixing portion. However, the heater power reaches the necessary amount of 18000 J by keeping the use of the auxiliary power source device 40 (discharger 43) for a while after the deterioration of the capacitor. In other words, it can be said that the heating can be continued for at least ten seconds without making the auxiliary heating be terminated during the rated ten seconds.

As described above, the specification of the predetermined fixing start-up time (here, ten seconds) of the electric storage device 42 (auxiliary power source device 40) is satisfied during the years of product guarantee. Even after the product guarantee period passes, and the fixing start-up time cannot be satisfied due to deterioration of the capacitor, the electric storage device 42 can be used continuously in accordance with a user's determination and selection of using the same under the above-described condition (the electric storage device 42 is replaced with new one if a user do not want to use the same under the above-described condition).

Meanwhile, according to the above-described configuration, the auxiliary power source device 40 is continuously used at the output of 900 W by the second heater 32 alone after the deterioration of the capacitor. However, in a state of the last stage of deterioration where deterioration of the capacitor further advanced, the input current in use of the 900 W output increases again. Due to the increase in the input current, there is a likelihood that the voltage-raising circuit comes to a state of causing a failure and the like. Therefore, like the above-described case, when the voltage detector 441 detects the first threshold value (first lower limit voltage) and thereafter detects a reaching of the input voltage from the electric storage device 42 to the discharger 43 to a predetermined voltage (hereinafter, referred to as second threshold value) set as a value in connection with a permissible limit of the input current to the discharger 43 like the case of the first lower limit voltage, the power supply controller 442 allows the discharger 43 to stop the voltage-raising and discharging of the discharger 43, thereby forcibly stopping the power supply from auxiliary power source device 40 to the second heater 32.

In an actual operation, the voltage detector 441 continuously monitors the input voltage from the electric storage device 42 to the discharger 43 after detecting the first lower limit voltage. When the voltage detector 441 detects a drop of the input voltage to a voltage (hereinafter, referred to as second lower limit voltage, the second lower limit voltage corresponding to the above-described second threshold value) further lower than the first lower limit voltage, it outputs the detection signal (detection result information) to the power supply controller 442. The power supply controller 442 receives the detection signal and outputs to the discharger 43 a control signal (hereinafter, referred to as discharger forcible turn-off signal) of stopping the driving of the discharger 43 (discharging circuit) i.e. a control signal of stopping the discharging operation. The discharger 43 receives the discharge forcible turn-off signal and then stops (switches off) the discharging operation. The discharger 43 prioritizes, in operation, the discharger forcible turn-off signal over the control signal transmitted from the control device 60 for controlling the discharging operation.

Figure 5:
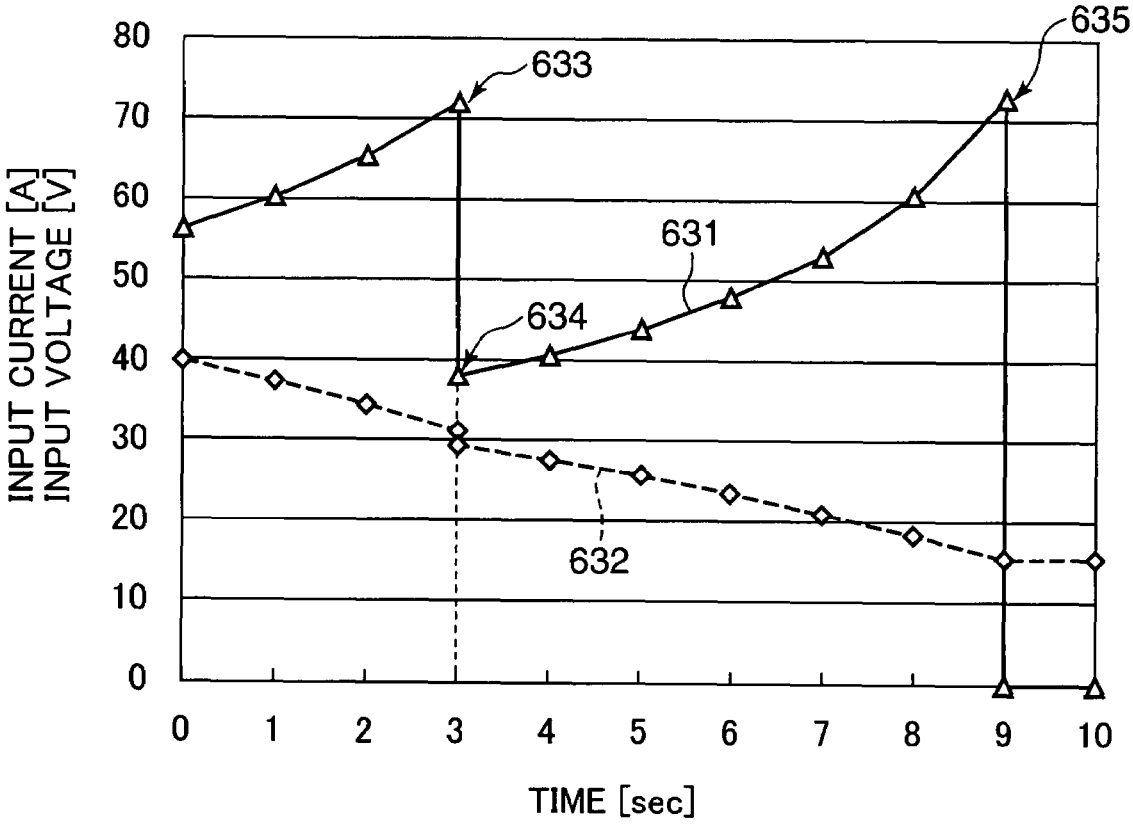
FIG. 5 is a graph showing chronological changes of the input voltage and the input current from the capacitor to the discharger in the last stage of deterioration of the capacitor.
Figure 6:
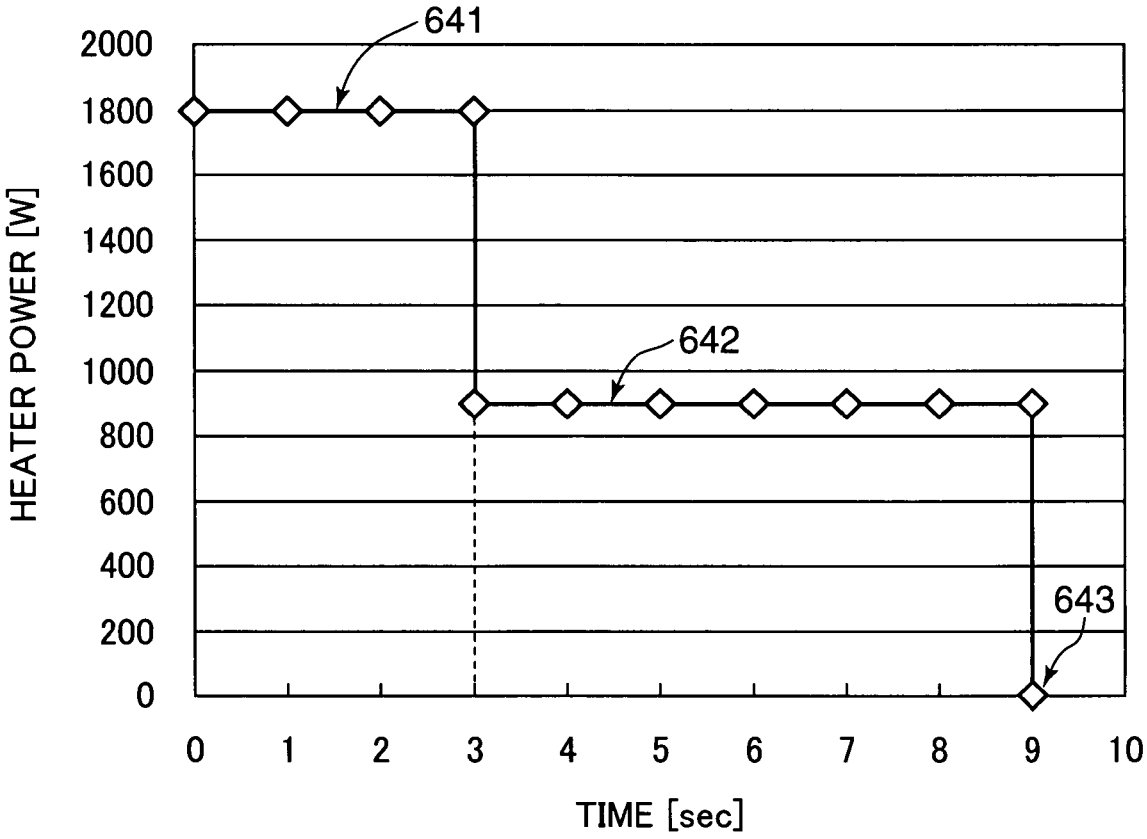
FIG. 6 is a graph corresponding to FIG. 5 and showing chronological changes of the total electric power of the second and third heat generators in the last stage of deterioration of the capacitor.

This operation will be described with a specific example. FIG. 5 is a graph showing chronological changes of the input voltage and the input current from the electric storage device 42 to the discharger 43 in the last stage of deterioration of the capacitor. The graph identified with reference numeral 631 in FIG. 5 shows an input current change characteristic (input current change characteristic 631). The graph identified with reference numeral 632 shows an input voltage change characteristic (input voltage change characteristic 632). FIG. 6 is a graph showing chronological changes of the total power value (Watt) of the second and third heaters 32, 33. The time axis of FIG. 6 corresponds to the time axis of FIG. 5.

As identified with reference numeral 641 in FIG. 6, the second heater 32 and the third heater 33 each having the rating power 900 W are driven together to start auxiliary heating at a heater power of 1800 W in total. As shown in the input voltage change characteristic 632 of FIG. 5, the input voltage initially being 40V gradually drops as time passes by. On the other hand, in accordance with the drop in the input voltage, the input current rises. When it is given that a rated value of the input current of the voltage-raising circuit in the discharger 43 is 75 A, the input current reaches the rated value or the value close to the rated value (here, the value close to but less than 75 A) at three seconds later, for example, as indicated by the point identified with the reference numeral 633. In other words, the capacitor comes to the end of the rated life duration. Since this is the case where deterioration of the capacitor advances further than the case of FIG. 3, the time taken before reaching the rated value is three seconds, which is shorter than eight seconds of the above-described case.

Therefore, when protecting unit 44 detects an input voltage of 29.9V (first threshold value; first lower limit voltage) at three seconds later, it switches off the third switch 53 to stop the power supply from the discharger 43 to the third heater 33. Accordingly, the second heater 32 becomes the only one heater which receives the power supply from the discharger 43, and the heater power having been 1800 W in the initial stage drops to 900 W as identified with reference numeral 642. At the time when the heater power drops to 900 W, the input current drops to half the rated value as indicated by the point identified with reference numeral 634 of in FIG. 5.

Thereafter, as the time passes by, the input voltage drops further. On the other hand, in accordance with the drop of the input voltage, the input current rises again. Then, at the time when the input voltage drops to 16.0V (second threshold value; second lower limit voltage), for example, at nine seconds later, the input current again reaches the upper limit value of the point identified with the reference numeral 635. Accordingly, at this time, the protecting unit 44 outputs the discharge forcible turn-off signal to the discharger 43 to stop the voltage-rising and the discharging thereof and the power supply from the discharger 43 to the second heater 32. Therefore, the heater power drops from 900 W to 0.0 (zero) W as identified with the reference numeral 643. However, a first lower limit voltage of "29.9V" and a second lower limit voltage of "16.0V" are the values acquired in advance by experiment and the like as input voltages at the time when the input current reaches the upper limit (rated value at the first time and second time. Further, the second lower limit voltage is not limited to 16.0V, and may be any desirable value.

As described above, when the voltage detector 441 of the protecting unit 44 monitors the input voltage and detects a reaching of the input voltage to the first lower limit voltage, the power supply controller 442 of the protecting unit 44 forcibly turns off the driving of one of the second and third heaters 32, 33 (third heater 33). Thereafter, the voltage detector 441 continues monitoring the input voltage. When the voltage detector 441 detects a reaching of the input voltage to the second lower limit voltage, the power supply controller 442 forcibly turns off the driving of the remaining heater (second heater 32). Accordingly, in the case where the capacitor is in the last stage of deterioration and the input current reaches the upper limit, the auxiliary heating by the heaters is switched to be performed with only one heater and continued. When the input current reaches the upper limit even with the heating by only one heater, this remaining heater is also switched off to prevent a failure and the like of the voltage-raising circuit, thereby allowing the heating time of auxiliary heating to be made as long as possible within a safe operation range of the voltage-raising circuit.

Figure 7:
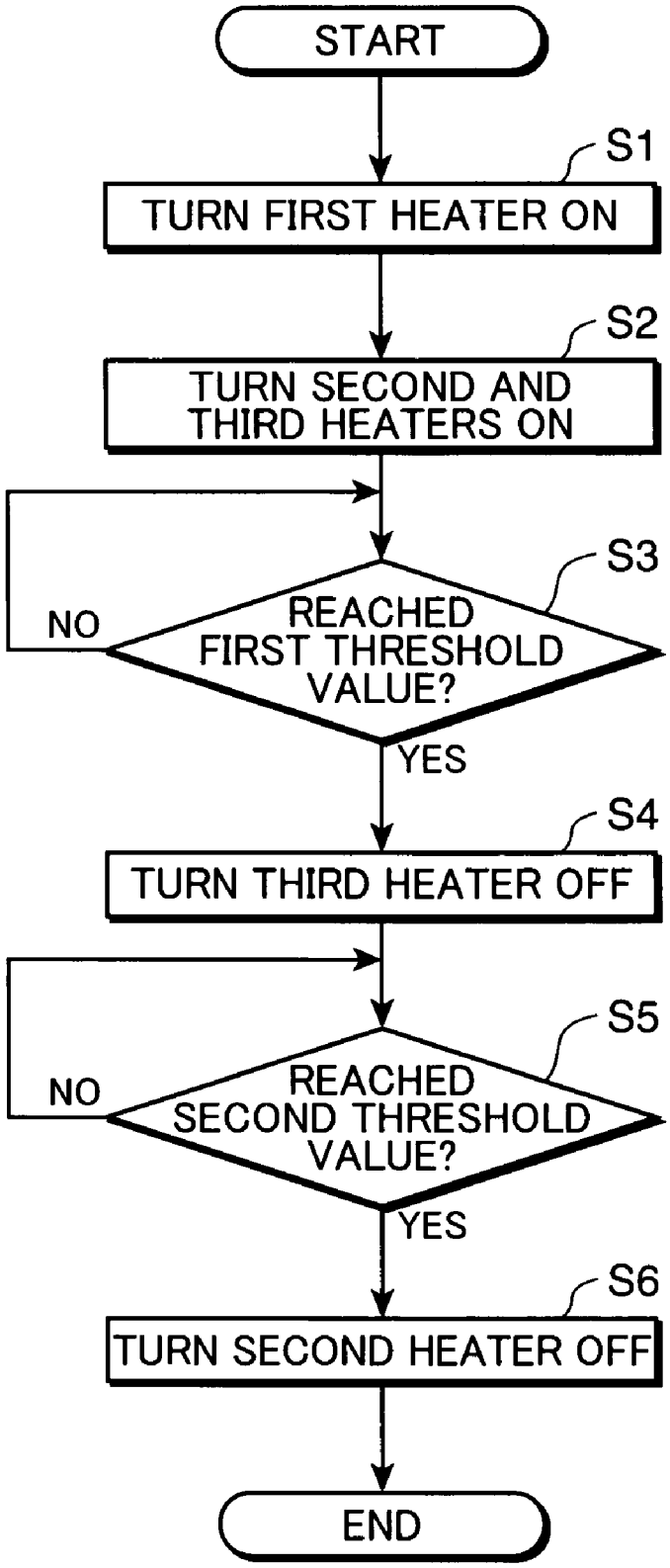
FIG. 7 is a flowchart concerning an example of a switching of auxiliary heaters in the heating system shown in FIG. 1.

FIG. 7 is a flowchart concerning an example of an auxiliary heater switching operation in the heating system according to an embodiment of the present invention. To perform the start-up of the fixing portion 107, the first heater 31 is driven (step S1) with the power supplied from the commercial power source 311, and the second heater 32 and the third heater 33 are driven (step S2) with the power supply from the auxiliary power source device 40. The voltage detector 441 (protecting unit 44) continuously monitors the input voltage from the electric storage device 42 to the discharger 43 (NO in step S3). When the voltage detector 441 detects a reaching of the input voltage to the first lower limit voltage (first threshold value) (YES in step S3), the power supply controller 442 (protecting unit 44) outputs the heater forcible turn-off signal to the third switch 53 to switch off the third switch 53, thereby forcibly stopping the power supply to the third heater 33. Accordingly, only the second heater 32 is driven as the auxiliary heater (step S4). Even after the first lower limit voltage is detected, the voltage detector 441 continuously monitors the input voltage from the electric storage device 42 to the discharger 43 (NO in step S5). When it is detected that the input voltage reaches the second lower limit voltage, the power supply controller 442 outputs the discharge forcible turn-off signal to the discharger 43 to stop the voltage-raising and the discharging of the discharger 43, thereby forcibly stopping the power supply to the second heater 32. Accordingly, driving of both of the auxiliary heaters (second and third heaters 32, 33) is stopped, and only the first heater 31 is driven (step S6).

As described above, according to the heating system 20 of the present embodiment, the heating device 30 includes the first heater 31 (first heat generator) supplied with electric power by the commercial power source 311, and the second heater 32 (second heat generator) and the third heater 33 (third heat generator) each supplied with electric power by the electric storage device 42 (auxiliary power source). Further, the discharger 43 raises the input voltage from the capacitor and discharges electricity to supply electric power to the second heater 32 and the third heater 33. Then, when the voltage detector 441 (detector) for detecting the input voltage from the electric storage device 42 to the discharger 43 detects a reaching of the input voltage to the first threshold value (first lower limit voltage) set as a value in connection with a permissible limit of the input current to the discharger 43, the power supply controller 442 switches off the electric power supply from the discharger 43 to the third heater 33. In other words, when the voltage detector 441 for detecting the input voltage from the electric storage device 42 (auxiliary power source) to the discharger 43 detects the reaching of the input voltage to the first threshold value which is set as a value in connection with a permissible limit of the input current to the discharger 43, the power supply controller 442 turns off the third switch of the power supply from the discharger 43 to the third heater 33. Accordingly, the power supply to the third switch 53 is forcibly stopped, and the power supply is performed by the electric storage device 42 only to the second heater 32. Accordingly, the auxiliary power supply is not disabled as soon as the input current to the discharger 43 reaches the permissible limit i.e. the rated life duration of the capacitor. Even after the capacitor reaches the end of the rated life duration, the power supply is switched to be performed to one of the second and third heaters 32, 33 (second heater 32), thereby reducing a load of the power supply (output level). Accordingly, the auxiliary power support can be continued within a safe operation range of the discharger 43 (voltage-raising circuit). Consequently, it becomes possible to maintain an effect of shortening the temperature start-up time (fixing start-up time) in accordance with use of the second and third heaters 32, 33 with the first heater 31.

Further, when the voltage detector 441 detects the first threshold value and thereafter detects the reaching of the input voltage to the second threshold value in connection with a permissible limit of the input current to the discharger 43, the power supply controller 442 stops the voltage-raising and the discharging of the discharger 43. Accordingly, the power supply from the electric storage device 42 to the second heater 32 is forcibly stopped. Accordingly, when the input current with respect to the discharger 43 reaches a permissible limit again while the electric storage device 42 is continuously used in a state where a first threshold value is detected and it is switched to the driving of using only the second heater 32, a driving of the second heater 32 is also stopped so that the discharger 43 can be prevented from coming into a failure and the like. In other words, a driving of the heater by the electric storage device 42 can be continued as long as possible within a safe operation range of the discharger 43. Further, since a limit is applied certainly to the input current to the discharger 43, there is no need to design the discharger 43 to be beyond the rating, and the discharger 43 can be made with low cost.

Further, since the heating device 30 is used as the fixing portion 107 (fixing device) provided with the heat roller 1071 including the first heater 31, second heater 32, and the third heater 33 as first through third heat generators, and the pressing roller 1072 of pressing the heat roller 1071, the heating system 20 may be adopted in an apparatus having the fixing portion 107, which corresponds to the copying machine 1 (image forming apparatus) here.

It should be noted that addition and modification of configuration is possible within a scope of a gist of the present invention. For example, the following modification can be made. Specifically, as a method of detecting (measuring) an input voltage from the electric storage device 42 to the discharger 43, an input current corresponding to the input voltage may be detected instead of detecting the input voltage. In such case, in FIG. 3, the input current at the point of reference numeral 603 instead of an input voltage is detected as a first threshold value. In FIG. 5, the input current at the point of reference numeral 633 is detected as a first threshold value. Further, as a second threshold value, the point of reference numeral 635 is detected.

As described above, the heating system of the present invention comprises: a heating device including a first heat generator supplied with electric power by a commercial power source, and a second heat generator and a third heat generator supplied with electric power by an auxiliary power source; an electric storage device composed of a capacitor; a discharger for pursuing discharge to raise an input voltage from the electric storage device and supply an electric power to the second and third heat generators; a detector for detecting an input voltage from the electric storage device to the discharger; and a power supply controller for switching off the electric power supply from the discharger to the third heat generator when the detector detects a reaching of the input voltage to a first threshold value which is set as a value in connection with a permissible limit of an input electric current to the discharger.

According to this arrangement, the heating device includes a first heat generator supplied with electric power by a commercial power source, and second and third heat generators supplied with an electric power by an auxiliary power source device. Further, the discharger pursues discharge to raise an input voltage from the electric storage device composed of a capacitor and supplies an electric power to the second and third heat generators. Further, when a detector for detecting an input voltage from the electric storage device to the discharger detects a reaching of the input voltage to a first threshold value which is set as a value in connection with a permissible limit of an input electric current to the discharger, the power supply controller switches off the electric power supply from the discharger to the third heat generator.

When the detector for detecting an input voltage from the electric storage device to the discharger detects a reaching of the input voltage to a first threshold value which is set as a value in connection with a permissible limit of an input electric current to the discharger, the power supply controller switches off the electric power supply from the discharger to the third heat generator. Accordingly, the electric power supply to the third generator is forcibly stopped, and the electric power is supplied from the auxiliary power source device to only the second heat generator. Consequently, the support is not disabled as soon as the input current to the discharger reaches a permissible limit, in other words, the input current reaches the rated life duration. Therefore, even after the capacitor reaches the rated life duration, the electric power supply is switched to the one with respect to one of the second and third heat generators (second heat generator) to reduce a load of the power supply (output level) by half, thereby continuing the electric power supply support with in a safe operation range of the discharger. Consequently, it becomes possible to maintain an effect of shortening a temperature start-up time (for example, fixing start-up time) with use of the second and third heat generators together with the first heat generator.

Further, when the detector detects a reaching of the input voltage to a second threshold value which is set as a value in connection with a permissible limit of the input electric current to the discharger after detecting the reaching of the input voltage to the first threshold value, the power supply controller controls the discharger to stop the voltage raising and the discharging.

According to this arrangement, when the detector detects a first threshold value and thereafter detects the reaching of the input voltage to the second threshold value in connection with a permissible limit of the input current to the discharger, the power supply controller stops the voltage raising and the discharging of the discharger.

Since the power supply controller stops the voltage raising and the discharging of the discharger when the detector detects a first threshold value and thereafter detects the reaching of the input voltage to the second threshold value in connection with a permissible limit of the input current to the discharger, the electric power supply from the auxiliary power source device to the second heat generator is forcibly stopped. Therefore, when the input current to the discharger reaches the permissible limit again while the electric storage device is continuously used in a state where the first threshold value is detected and the driving is switched to be performed only by the second heat generator, the second heat generator is also stopped so that the discharger is prevented from coming to a failure. In other words, driving of the heat generator by the auxiliary power source can be continued as long as possible within a safe operation range of the discharger. Further, since a limit is certainly applied to the input current to the discharger, it becomes not necessary to design the discharger to be beyond the rating, and the discharger can be made with low cost.

Further, the heating device is a fixing device provided with a heating roller having first, second and third heaters corresponding to the first, second and third heat generators, and a pressing roller for applying a pressing force to the heating roller.

According to this, heating device is made a fixing device provided with a heating roller having first, second and third heaters corresponding to the first, second and third heat generators, and a pressing roller for applying a pressing force to the heat roller. Since the heating device is made to be such fixing device, the heating system may be adopted in an equipment having the fixing device. For example, it can be adopted in an image forming apparatus.

Further, an image forming apparatus according to the present invention includes the heating system of the above. According to this, an image forming apparatus is provided with the heating system. Accordingly, an image forming apparatus having an operation of the above-described heating system can be obtained.

This application is based on Japanese Patent application serial no. 2006-211058 filed on Aug. 2, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A heating system comprising:

a heating device including a first heat generator supplied with electric power by a commercial power source, and a second heat generator and a third heat generator supplied with electric power by an auxiliary power source device;

an electric storage device composed of a capacitor;

a discharger for pursuing discharge, that raises an output voltage of the electric storage device and supplies electric power to the second and third heat generators;

a detector for detecting an output voltage of the electric storage device to the discharger; and a power supply controller for switching off the electric power supply from the discharger to the third heat generator when the detector detects a reaching of said output voltage to a first threshold value which is set as a value in connection with a permissible limit of an input electric current to the discharger.

2. The heating system according to claim 1, wherein the heating device is a fixing device provided with a heating roller having first, second and third heaters corresponding to the first, second and third heat generators, and a pressing roller for applying a pressing force to the heating roller.

3. An image forming apparatus comprising the heating system according to claim 2.

4. A heating system comprising:

a heating device including a first heat generator supplied with electric power by a commercial power source, and a second heat generator and a third heat generator supplied with electric power by an auxiliary power source device;

an electric storage device composed of a capacitor;

a discharger for pursuing discharge, raises an output voltage of the electric storage device and supplies electric power to the second and third heat generators;

a detector for detecting an output voltage of the electric storage device to the discharger; and a power supply controller for switching off the electric power supply from the discharger to the third heat generator when the detector detects a reaching of said output voltage to a first threshold value which is set as a value in connection with a permissible limit of an input electric current to the discharger, wherein when the detector detects a reaching of the input voltage to a second threshold value which is set as a value in connection with a permissible limit of the input electric current to the discharger after detecting the reaching of the input voltage to the first threshold value, the power supply controller controls the discharger to stop the voltage raising and the discharging.

* * * * *